US007891660B2

(12) United States Patent
Mutschall et al.

(10) Patent No.: US 7,891,660 B2
(45) Date of Patent: Feb. 22, 2011

(54) DEVICE FOR THE TRANSPORT OF SHEETS BY MEANS OF A CHAIN-DRIVEN GRIPPER BAR

(75) Inventors: Stefan Mutschall, Östringen (DE); Andreas Böttger, Heidelberg (DE); Markus Möhringer, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 353 days.

(21) Appl. No.: 12/054,003

(22) Filed: Mar. 24, 2008

(65) Prior Publication Data

US 2008/0229951 A1 Sep. 25, 2008

(30) Foreign Application Priority Data

Mar. 22, 2007 (DE) ..... 10 2007 013 805

(51) Int. Cl.
*B65H 29/04* (2006.01)

(52) U.S. Cl. ..... 271/204; 271/82

(58) Field of Classification Search ..... 271/82, 271/85, 277, 204, 206, 205; 101/232, 408, 101/409; 59/4, 93; 198/466.1, 473.1, 817
See application file for complete search history.

(56) References Cited

U.S. PATENT DOCUMENTS 3,861,672 A * 1/1975 Norton ..... 271/203
3,878,735 A * 4/1975 Preuss ..... 198/500
4,638,906 A * 1/1987 Winiasz ..... 198/803.9
4,693,362 A * 9/1987 Kemmerer et al. ..... 198/803.7
5,056,773 A * 10/1991 Weisgerber ..... 271/204
5,411,133 A * 5/1995 Lyndhurst ..... 198/845
5,722,530 A * 3/1998 Gunschera ..... 198/803.7
5,758,576 A 6/1998 Mack et al.
6,182,567 B1 2/2001 Gunschera et al.
6,786,482 B2 * 9/2004 Spatz ..... 271/185
7,232,123 B2 6/2007 Förch et al.

FOREIGN PATENT DOCUMENTS

DE 1 112 535 8/1961
DE 2 246 061 10/1973
DE 2 458 446 A1 7/1975
DE 195 27 439 C2 2/1997
DE 198 59 358 A1 9/1999
DE 10 2004 044 122 A1 5/2005

OTHER PUBLICATIONS

German Search Report, dated Nov. 19, 2007.

* cited by examiner

*Primary Examiner*—Stefanos Karmis
*Assistant Examiner*—Thomas A Morrison
(74) *Attorney, Agent, or Firm*—Laurence A. Greenberg; Werner H. Stemer; Ralph E. Locher

(57) ABSTRACT

In a device for the transport of sheets in a sheet-processing machine, preferably a printing press, provision is made to transport the sheets on chain-guided gripper bars. The gripper bars are fixed respectively to two chain links arranged indirectly beside each other. The forces acting on the gripper bars are more evenly distributed.

7 Claims, 5 Drawing Sheets

DEVICE FOR THE TRANSPORT OF SHEETS BY MEANS OF A CHAIN-DRIVEN GRIPPER BAR

CROSS-REFERENCE TO RELATED APPLICATION

This application claims the priority, under 35 U.S.C. §119, of German application DE 10 2007 013 805.0, filed Mar. 22, 2007; the prior application is herewith incorporated by reference in its entirety.

BACKGROUND OF THE INVENTION

Field of the Invention

The invention relates to a gripper bar for the transport of sheets in a sheet-processing machine, in particular in the delivery of a printing press, the gripper bar being arranged on driven chains.

A device of this type is described in the commonly assigned German patent DE 195 27 439 C2 and its counterpart U.S. Pat. No. 5,758,576. There, the gripper bar is attached to two chains guided in parallel in side frames, in each case by way of a rigid pin connection to a chain link. The two pins of a chain link are thereby designed to be so long that the gripper bar can be fixed thereto. In the event of high loadings of the gripper bar, the chain links tend to slip on an inner edge. This leads to premature abrasion of the chain as a result of increased wear.

BRIEF SUMMARY OF THE INVENTION

It is accordingly an object of the invention to provide a device for transporting sheets by way of a chain-driven gripper bar which overcomes the above-mentioned disadvantages of the heretofore-known devices and methods of this general type and which provides for an attachment of the gripper bar to the transport chains which eliminates the above disadvantages.

With the foregoing and other objects in view there is provided, in accordance with the invention, a sheet transport device, comprising:

a gripper bar;

transport chains for driving said gripper bar, said transport chains having a plurality of alternately arranged inner and outer links, and chain pins connecting said inner and outer links to one another;

wherein said gripper bar is mounted to two different chain links of a respective said transport chain; and wherein a bearing point is disposed between two chain pins of a common said chain link.

It is a great advantage of the invention that the gripper bar is arranged on the transport chains in an articulated manner. In this way, the chains rest on their chain tracks virtually without any torques, since only normal forces still act.

In order to achieve good support on the chain tracks of the transport chains, which are preferably implemented as roller chains, two bearing points are provided on the adjacent inner links and adjacent outer links, respectively, at least one outer or inner link being arranged between two inner or outer links. As a result of this measure, the forces applied by the gripper bar are distributed uniformly to a plurality of chain links and thus to a plurality of chain rollers on each side, for instance to four chain rollers per transport chain.

In accordance with an added feature of the invention, the bearings between the gripper bar and the transport chain are formed by spherical ball and socket bearings. Preferably, one spherical ball and socket bearing is formed as a fixed bearing and rigidly connected to a respective inner link or outer link. Additionally, one spherical ball and socket bearing may be formed as a loose bearing configured to be movable in a sheet transport direction in a groove formed in a respective inner link or outer link.

As mentioned above, the transport chains are preferably formed with chain rollers. These are preferably disposed in each case at a connecting point between a respective said inner link and outer link. In a preferred embodiment of the invention, there is provided a rail forming a lower guide rollingly supporting said chain rollers, and an upper guide for said chain rollers.

In accordance with a preferred feature of the invention, each gripper bar is mounted to said transport chains by way of a fixed bearing, a loose bearing with one degree of freedom, and two loose bearings each having two degrees of freedom.

In accordance with a concomitant feature of the invention, the transport device is a chain-driven gripper bar in a delivery of a printing press.

Other features which are considered as characteristic for the invention are set forth in the appended claims.

Although the invention is illustrated and described herein as embodied in a device for the transport of sheets by means of a chain-driven gripper bar, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
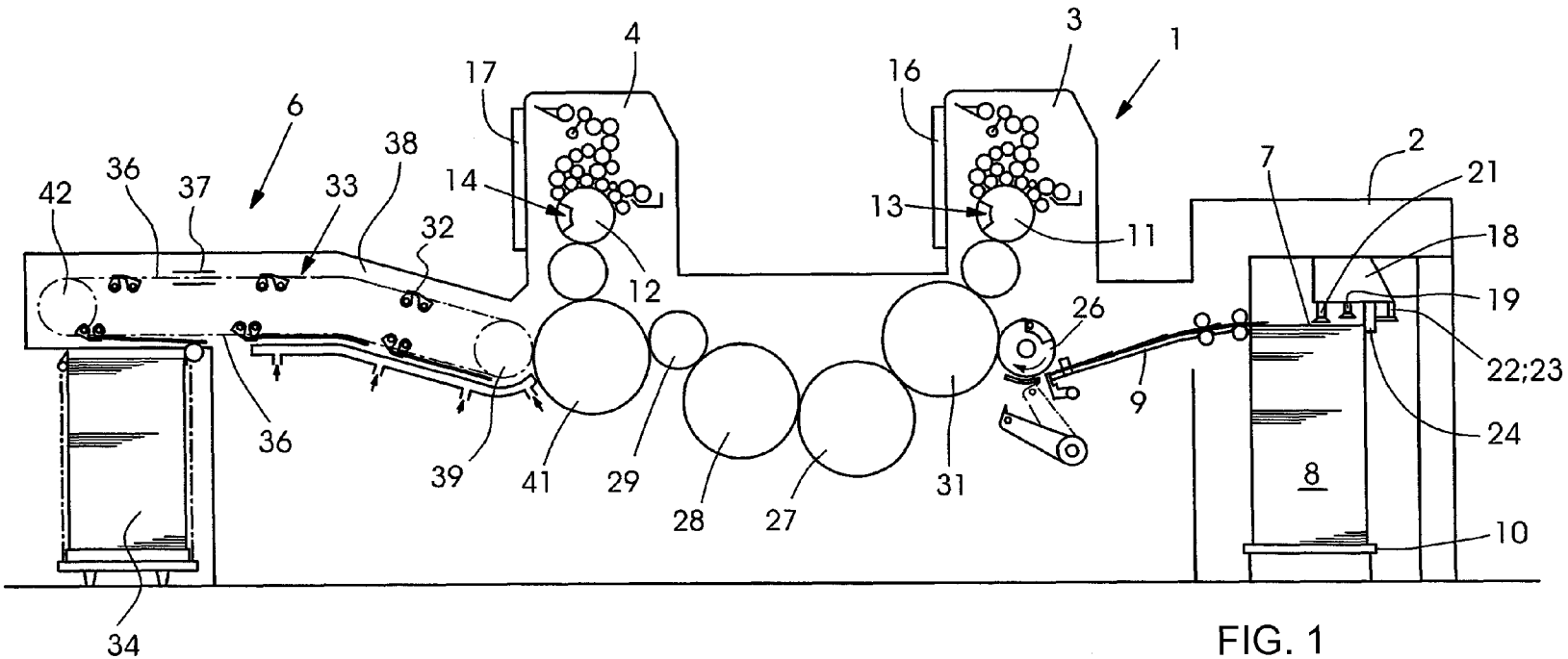
FIG. 1 is a schematic, sectional side view of a rotary press.
Figure 2:
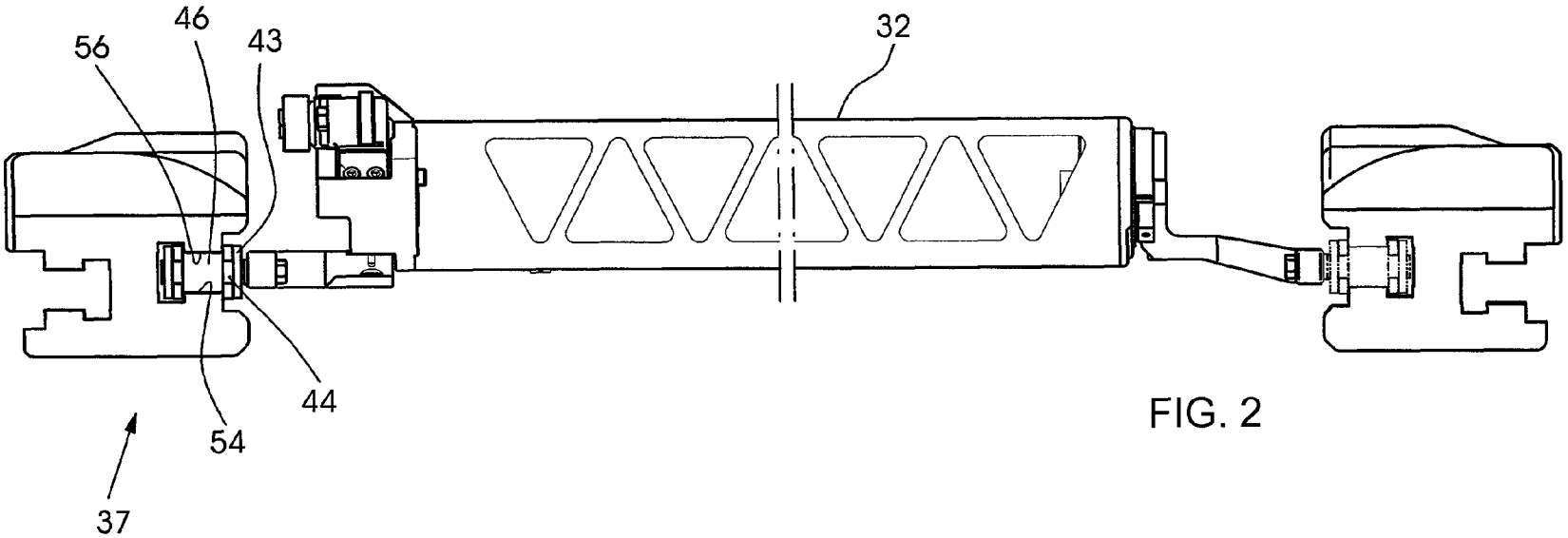
FIG. 2 is a plan view of a gripper bar in the delivery of a sheet-processing machine.

Referring now to the figures of the drawing in detail and first, particularly, to FIG. 1 thereof, there is seen a sheet-processing machine, represented here by a printing press 1. The machine has a feeder 2, at least one printing unit 3 and 4 and a delivery 6. Sheets 7 are removed from a sheet stack 8 and, separated or overlapping, are fed over a feed table 9 to the printing units 3 and 4. The printing units each contain, in a known way, a plate cylinder 11, 12. The plate cylinders 11 and 12 each have a device 13, 14 for fixing flexible printing plates. Furthermore, each plate cylinder 11, 12 is assigned a device 16, 17 for fully automatic or semiautomatic printing plate exchange.

The sheet stack 8 rests on a stack board 10 that can be raised under control. The sheets 7 are removed from the top of the sheet stack 8 by means of what is known as a suction head 18 which, inter alia, has a number of lifting and dragging suckers 19, 21 for separating the sheets 7. Furthermore, blowing devices 22 for loosening the upper sheet layers and sensing elements 23 for stack tracking are provided. In order to align the sheet stack 8, in particular the upper sheets 7 of the sheet stack 8, a number of side and rear stops 24 are provided.

The sheets are transported though the machine by way of a number of sheet-carrying cylinders equipped with gripper devices, e.g. a feed cylinder 26, a first impression cylinder 31, a transfer drum 27, a storage drum 28, a turner drum 29 and a second impression cylinder 41, from which the sheets are transferred to a gripper bar 32 of a chain delivery system 33.

The chain delivery system 33 has two transport chains 36 arranged in parallel, which are preferably formed as roller chains. These are guided in guides 37 in the side frame 38 of the delivery 6 and deflected over two chain wheels 39, 42, of which at least one is driven.

The transport chains 36 carry a relatively large number of gripper bars 32 spaced apart from one another in the sheet transport direction. The transport chains 36 each have a large number of chain links, outer links 43 and inner links 44 alternating.

Figure 3:
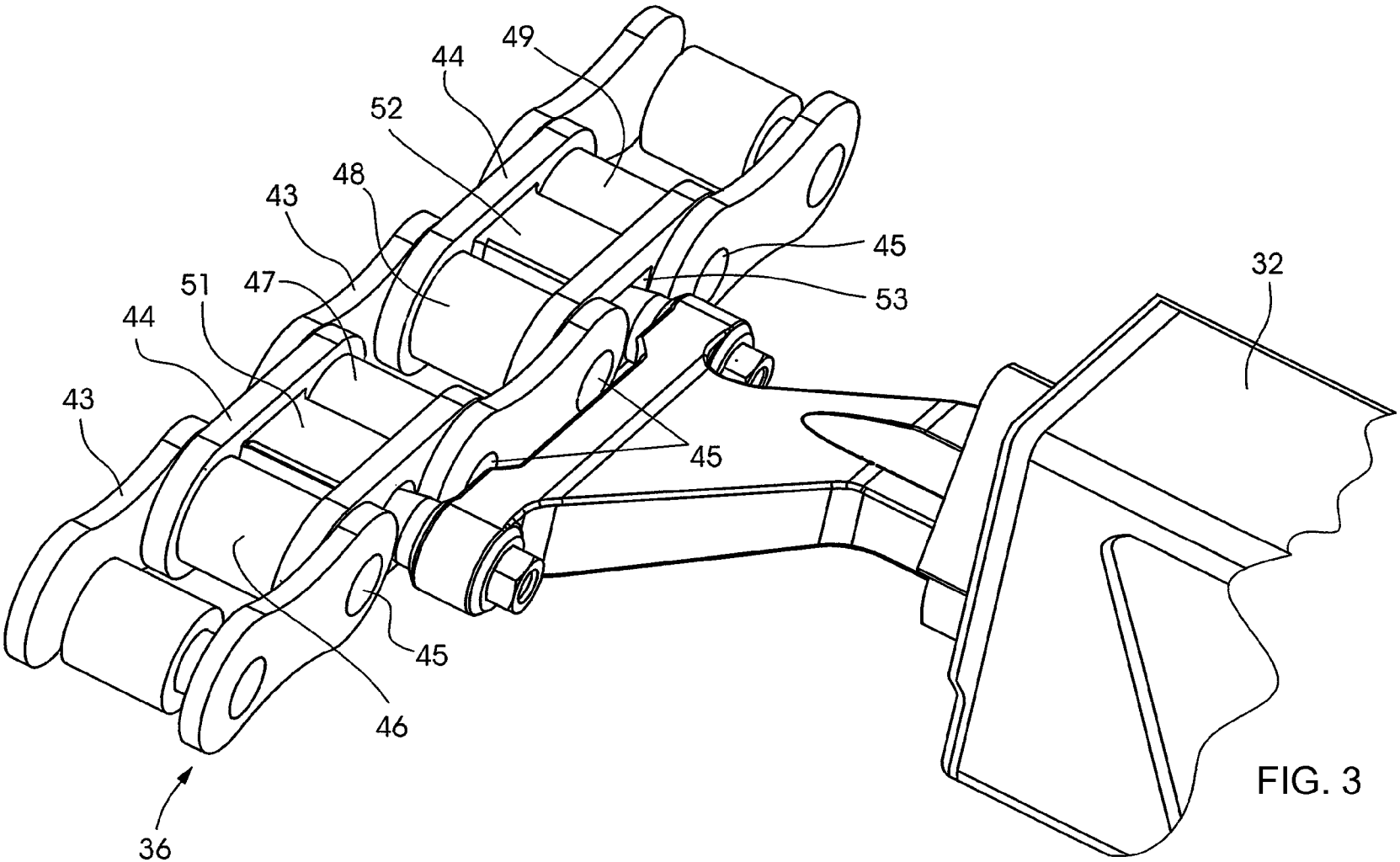
FIG. 3 is a perspective view of an attachment of the gripper bar to a roller chain.
Figure 4:
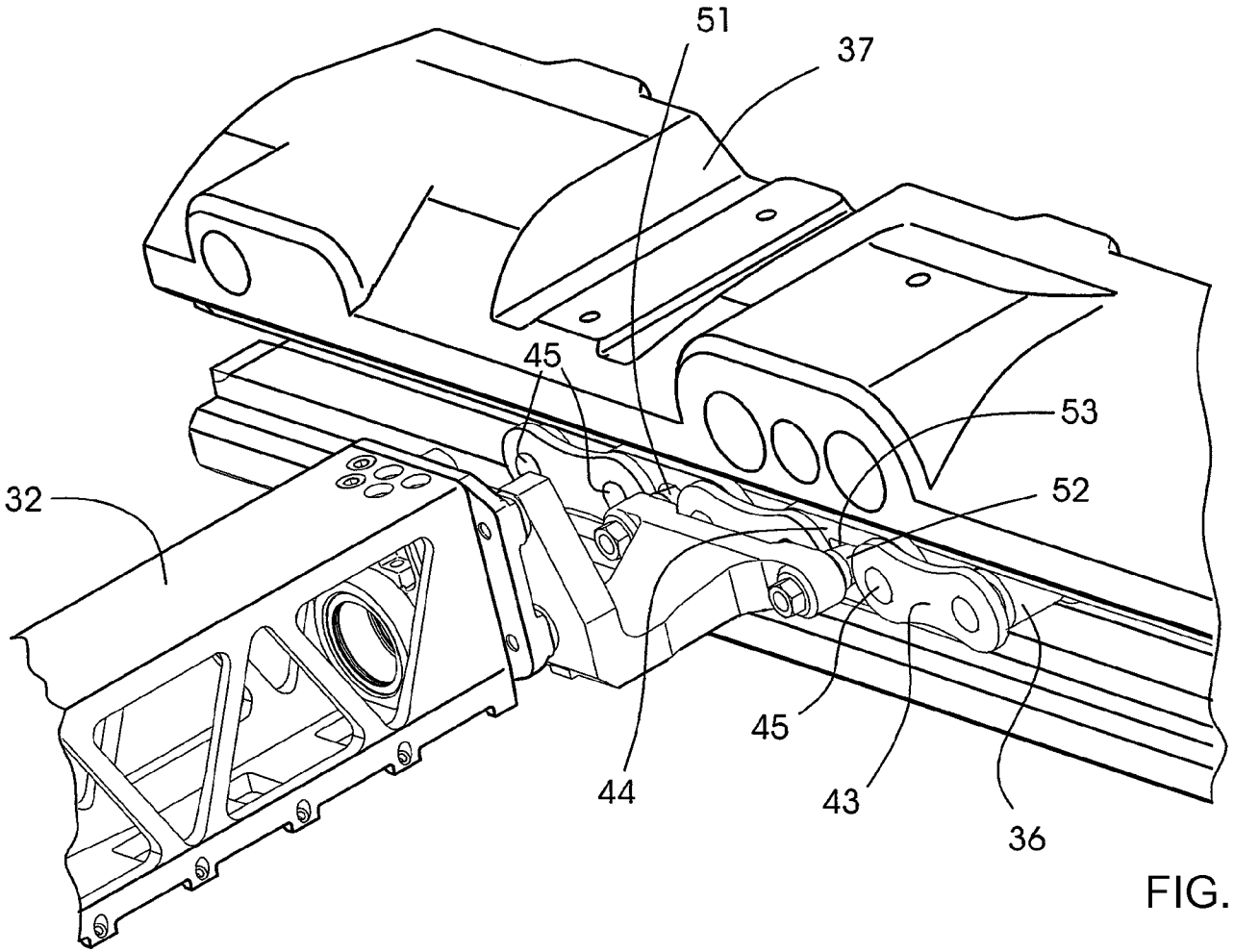
FIG. 4 is a perspective view of the gripper bar guidance in the sheet transport direction.

In order to fix the gripper bars 32 to the transport chains 36, provision is made, for example according to FIG. 3, for these to be arranged on two chain links spaced apart from each other, e.g. 43-43 or 44-44. As a result of this measure, the gripper bar 32 is carried by four rollers 46, 47, 48, 49 of the chain links 43, 44.

The fixing or bearing points 51, 52 of the gripper bar 32 are in each case arranged between two chain pins 45 which in each case connect an inner link 44 and an outer link 43 to each other. Rollers 46; 47, 48; 49 are preferably arranged on the chain pins 45.

Of course, these fixing or bearing points 51, 52 of the gripper bar 32 can also be provided between two rollers, e.g. 47, 48, of outer links 43.

If the gripper bar 32 is to be carried by three rollers, the bearing points 51, 52 on an inner link 44 and a directly adjacent outer link 43 must in each case be arranged between the chain pins 45.

The fixing or bearing points 51, 52 of the gripper bar 32 are formed as ball and socket bearings.

In the exemplary embodiment according to FIG. 3, the ball and socket bearing 52 is a spherical ball and socket bearing and is arranged such that it can be displaced in a groove 53 in the chain link 43 or 44 and thus serves as a loose bearing. The ball and socket bearing 51 is likewise formed as a spherical ball and socket bearing and serves as a fixed bearing.

Figure 5:
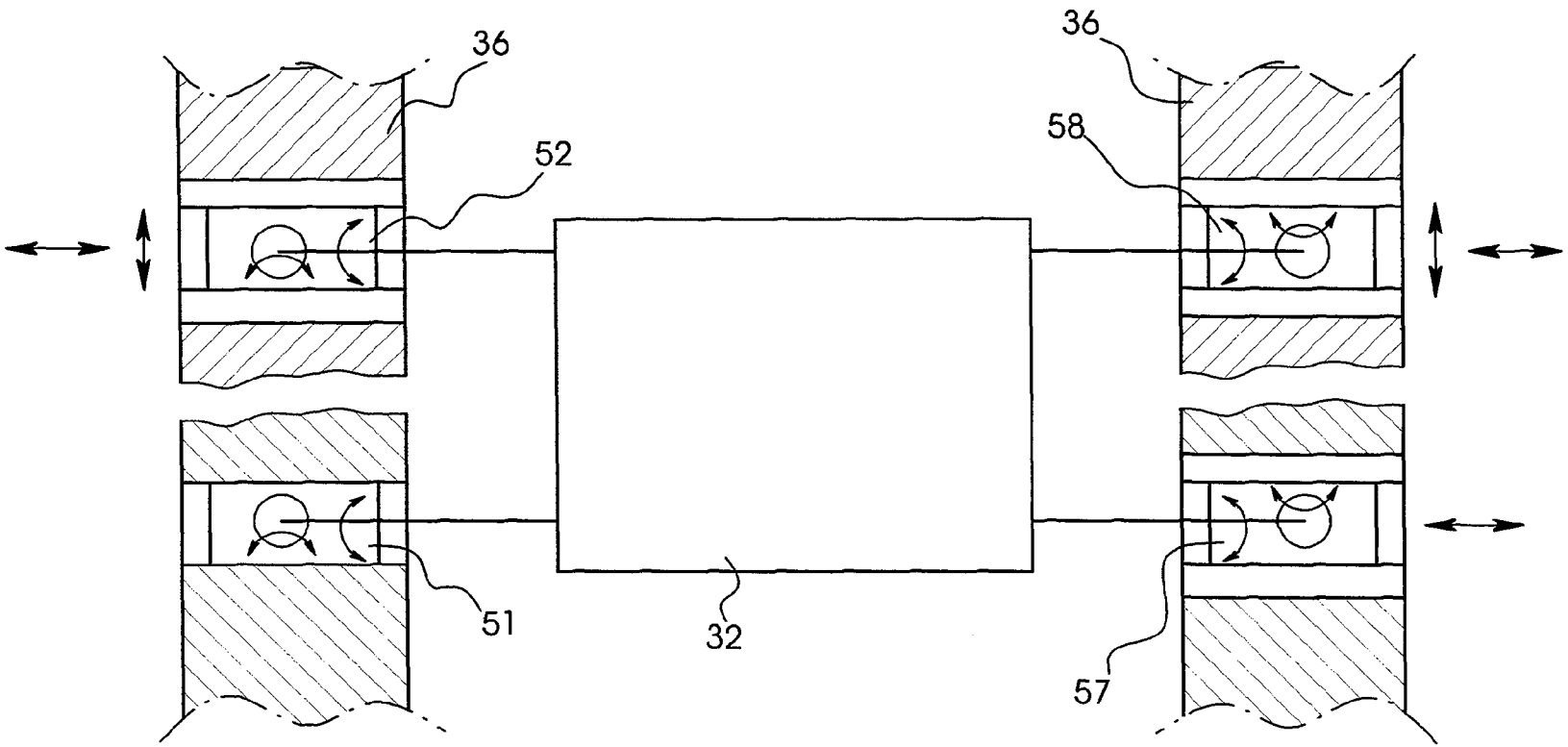
FIG. 5 is a schematic illustration showing a section through the bearing plane.

FIG. 5 shows the mounting of the gripper bar 32 on both sides on the transport chains 36.

In addition to the degrees of freedom of a spherical ball and socket bearing, the fixed bearing 51 has no further degrees of freedom. The adjacent loose bearing 52 additionally has two degrees of freedom in the axial direction and in the transport direction. A loose bearing 57 arranged opposite the fixed bearing 51 on the opposite side has an additional degree of freedom in the axial direction. An adjacent loose bearing 58 has two additional degrees of freedom in the axial direction and in the transport direction. By means of this special mounting, the result is a torque-free bearing point of the gripper bar 32 in the chains 36.

The invention claimed is:

1. A sheet transport device, comprising:

a gripper bar;

transport chains for driving said gripper bar, said transport chains having a plurality of alternately arranged inner and outer links, and chain pins connecting said inner and outer links to one another;

said gripper bar being mounted to two different chain links of a respective said transport chain; and a bearing point being disposed between two chain pins of a common said chain link;

spherical ball and socket bearings forming bearings between said gripper bar and said transport chains, one spherical ball and socket bearing being formed as a fixed bearing and rigidly connected to a respective said inner link or outer link.

2. The device according to claim 1, wherein said transport chains include a plurality of chain rollers.

3. The device according to claim 2, wherein said chain rollers are disposed in each case at a connecting point between a respective said inner link and outer link.

4. The device according to claim 3, which comprises a rail forming a lower guide rollingly supporting said chain rollers, and an upper guide for said chain rollers.

5. The device according to claim 1, configured as a chain gripper transport device in a delivery of a printing press.

6. A sheet transport device, comprising:

a gripper bar;

transport chains for driving said gripper bar, said transport chains having a plurality of alternately arranged inner and outer links, and chain pins connecting said inner and outer links to one another;

said gripper bar being mounted to two different chain links of a respective said transport chain; and a bearing point being disposed between two chain pins of a common said chain link;

spherical ball and socket bearings forming bearings between said gripper bar and said transport chains;

one spherical ball and socket bearing being formed as a loose bearing configured for being movable in a sheet transport direction in a groove formed in a respective said inner link or outer link.

7. A sheet transport device, comprising:

a gripper bar;

transport chains for driving said gripper bar, said transport chains having a plurality of alternately arranged inner and outer links, and chain pins connecting said inner and outer links to one another;

said gripper bar being mounted to two different chain links of a respective said transport chain;

a bearing point being disposed between two chain pins of a common said chain link; and each gripper bar being mounted to said transport chains by way of a fixed bearing, a loose bearing with one degree of freedom, and two loose bearings each having two degrees of freedom.

* * * * *